US007059395B2

(12) United States Patent
Bousquet et al.

(10) Patent No.: US 7,059,395 B2
(45) Date of Patent: Jun. 13, 2006

(54) PERFORMANCE HEAT EXCHANGER, IN PARTICULAR AN EVAPORATOR

(75) Inventors: Frédéric Bousquet, la Suze/Sarthe (FR); Sylvain Moreau, Spay (FR); Jean-Michel Bouzon, le Mans (FR)

(73) Assignee: Valeo Climatisation, la Verriere (FR)

( * ) Notice: Subject to any disclaimer, the term of this patent is extended or adjusted under 35 U.S.C. 154(b) by 355 days.

(21) Appl. No.: 10/481,300

(22) PCT Filed: Jun. 24, 2002

(86) PCT No.: PCT/FR02/02183

§ 371 (c)(1),
(2), (4) Date: Dec. 19, 2003

(87) PCT Pub. No.: WO03/001134

PCT Pub. Date: Jan. 3, 2003

(65) Prior Publication Data

US 2004/0182554 A1 Sep. 23, 2004

(30) Foreign Application Priority Data

Jun. 26, 2001 (FR) ..... 01 08414

(51) Int. Cl.
*F28D 7/06* (2006.01)

(52) U.S. Cl. ..... 165/153; 165/176

(58) Field of Classification Search ..... 165/153, 165/176; 62/515

See application file for complete search history.

(56) References Cited

U.S. PATENT DOCUMENTS

| | | | | | |
|---|---|---|---|---|---|
| 4,274,482 | A * | 6/1981 | Sonoda | 165/153 |
| 5,094,293 | A * | 3/1992 | Shinmura | 165/178 |
| 5,553,664 | A * | 9/1996 | Nishishita et al. | 165/153 |
| 5,617,914 | A * | 4/1997 | Kinugasa et al. | 165/153 |
| 5,810,077 | A * | 9/1998 | Nakamura et al. | 165/153 |
| 5,901,785 | A * | 5/1999 | Chiba et al. | 165/174 |
| 6,032,729 | A * | 3/2000 | Nishishita et al. | 165/153 |
| 6,129,144 | A * | 10/2000 | Bousquet | 165/153 |
| 6,145,587 | A * | 11/2000 | Hanafusa | 165/153 |
| 6,161,616 | A * | 12/2000 | Haussmann | 165/176 |
| 6,585,038 | B1 * | 7/2003 | Bousquet et al. | 165/153 |

FOREIGN PATENT DOCUMENTS

| | | |
|---|---|---|
| EP | 0625686 | * 11/1994 |
| EP | 0798533 | * 10/1997 |
| EP | 0911595 | * 4/1999 |
| GB | 2250336 | * 6/1992 |

* cited by examiner

*Primary Examiner*—Teresa J. Walberg
(74) *Attorney, Agent, or Firm*—Ronald Courtney

(57) ABSTRACT

A heat exchanger for exchange of heat between a first fluid and a second fluid comprises a stack of pockets (1) mutually aligned in a longitudinal direction and having two header boxes (16, 17) that are mutually juxtaposed in a lateral direction. The first fluid is injected into an upstream connecting channel (12) by a longitudinal nozzle (22) passing through a heat exchanger end face (5) remote from the upstream connecting channel, and at least one other connecting channel (14). This longitudinal nozzle has a cross section of oblong general shape, whose greatest dimension is parallel to the greatest dimension of the pockets. The heat exchanger may be produced particularly in the form of an evaporator for an air-conditioning device for the passenger compartment of a vehicle.

10 Claims, 2 Drawing Sheets

PERFORMANCE HEAT EXCHANGER, IN PARTICULAR AN EVAPORATOR

BACKGROUND OF THE INVENTION

The invention relates to heat exchangers, especially for motor vehicles.

It relates more particularly to a heat exchanger for heat exchange between a first fluid and a second fluid, comprising a stack of pockets mutually aligned in a longitudinal direction and having two header boxes that are mutually juxtaposed in a lateral direction and are each formed by the alignment, in the longitudinal direction, of inlet or outlet chambers belonging respectively to the different pockets, the header boxes as a whole being divided into at least three connecting channels, and in which exchanger the first fluid is injected into an upstream connecting channel by a longitudinal nozzle passing through a heat exchanger end face remote from the upstream connecting channel, and at least one other connecting channel formed by other pockets.

DESCRIPTION OF THE PRIOR ART

The prior art, particularly in EP 0 911 595, already discloses a heat exchanger of this type, in which the connecting channels that belong to one header box all come one after the other in the longitudinal direction and do not communicate directly with each other, whereas within each connecting channel the inlet or outlet chambers communicate with each other via openings in the walls of the pockets.

The pockets define a pathway for the first fluid between an upstream connecting channel adjacent to a first longitudinal end of the stack and a downstream connecting channel adjacent to the second longitudinal end of the stack, passing back and forth between a connecting channel belonging to one of the header boxes and a connecting channel belonging to the other header box, via U paths, each of which connects together the inlet chamber and outlet chamber of one pocket. The upstream and downstream connecting channels are connected to inlet and outlet passages provided at one of said longitudinal ends, one directly and the other through the aforementioned longitudinal nozzle. This nozzle runs through the openings of the connecting channels interposed between this end and said other connecting channel.

Such heat exchangers are in wide use as evaporators in air-conditioning devices for the passenger compartment of vehicles.

The pockets are each made up of two metal sheets pressed into the form of troughs in which the concavities are turned toward each other and which are connected together in a fluidtight manner around their periphery, the inlet and outlet chambers being defined by regions of the troughs that are deeper than the remaining regions, so that a gap is left between two neighboring pockets, between said remaining regions, for the passage of the second fluid in the lateral direction, and said openings are formed in the bottoms of the troughs which are in mutual fluidtight contact around the openings.

The two troughs of each pocket are also connected fluidtightly in a middle area halfway across their widths and along a notable fraction of their length beginning at a first end edge, the two branches of the said U path extending on either side of said middle area, as do said deeper regions of the troughs, situated near said first end edge.

In the known heat exchangers of this type, the longitudinal nozzle, also known as a pipette, has a circular cross section as taught by the publication EP 0 911 595.

One of the objects of the invention is to further improve the operating characteristics of these exchangers.

It is also designed to improve the passage of the first fluid and the balance of the heat exchanger.

SUMMARY OF THE INVENTION

To this end the invention provides a heat exchanger of the type defined in the introduction, in which the longitudinal nozzle has a cross section of oblong general shape, whose greatest dimension is parallel to the greatest dimension of the pockets.

It has been found that, due to its oblong cross section, this longitudinal nozzle improves the passage of the first fluid and can also be positioned in such a way as not to partly block the chambers defined in the pockets. Furthermore, with this special shape, the longitudinal nozzle is more suitable for the shape of the header boxes in the case in which the plates are narrow (in the lateral direction), typically less than 60 mm wide.

Optional features of the invention, whether supplementary or alternative, are set out below:

- The cross section of the longitudinal nozzle is of oval general shape.
- The longitudinal nozzle is fixed to an end box fitted to said end face.
- The end box has a first cavity with an opening into which the longitudinal nozzle passes and a second cavity with an opening leading into a downstream connecting channel adjacent to said end of the heat exchanger.
- The end box accommodates a shaped plate defining an entrance piece communicating with the first cavity and an exit piece communicating with the second cavity.
- The longitudinal nozzle is crimped to the edges of the opening of the first cavity.
- The longitudinal nozzle is brazed to the edges of an opening allowing communication between the upstream connecting channel and an adjacent connecting channel through which the longitudinal nozzle passes.
- The adjacent connecting channel extends to the end face of the heat exchanger.
- The longitudinal nozzle is brazed to the outer edge of the openings that allow communication between adjacent pockets.
- The longitudinal and lateral directions are essentially horizontal and the header boxes are located at the top of the exchanger.

DESCRIPTION OF THE DRAWINGS

The description that follows, offered purely by way of example, refers to the appended drawings, in which.

DESCRIPTION OF THE PREFERRED EMBODIMENTS

Figure 1:
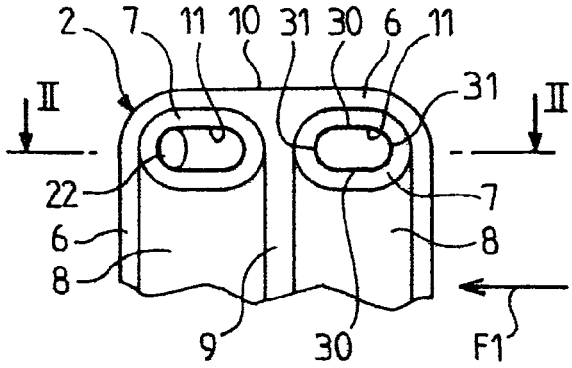
FIG. 1 is a partial view of a heat exchanger according to the invention, in section on the line marked I—I in FIG. 2.

The heat exchanger shown in the drawings is an evaporator intended for an air-conditioning device for the passenger compartment of a motor vehicle. It comprises a multiplicity of pockets 1 stacked together in an essentially horizontal longitudinal direction and each made up of two metal sheets pressed into trough shapes 2 and 3. The latter are identical with each other and have their concavities turned toward each other, i.e. toward second and first longitudinal ends 5, 4 of the stack. Each trough has an outer edge 6 situated in a vertical plane, and the outer edges 6 of the two troughs forming one pocket are assembled fluidtightly together by brazing, to define the internal volume of the pocket.

Figure 2:
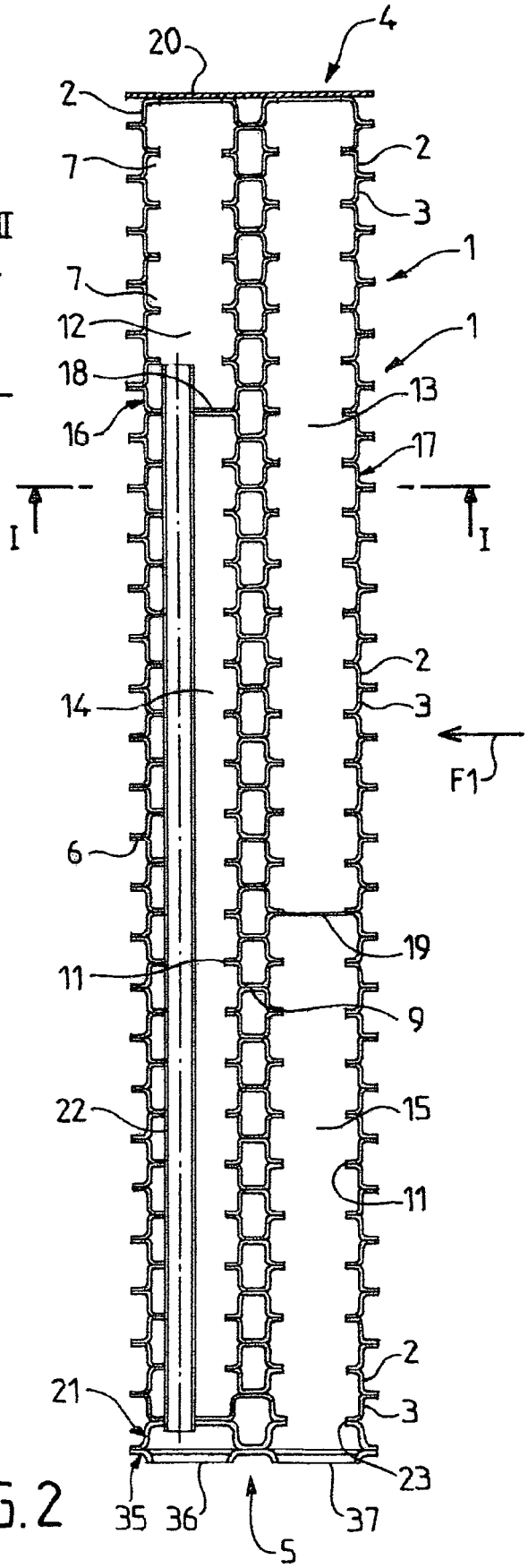
FIG. 2 is a top view of the heat exchanger, in section on the line marked II—II in FIG. 1.

Each trough also has at its top, two regions 7 that are deeper than the remaining region 8, this latter region occupying the greater part of the height of the trough, below the regions 7 (FIG. 2). These two deeper regions of each trough, which are juxtaposed from left to right in the figures, define in each pocket an inlet chamber and an outlet chamber for a first fluid, which in the present case is the coolant.

The inlet chamber and outlet chamber of each pocket are separated from each other by a fluidtight joining area 9 between the two troughs, halfway across the width of the pocket, this joining area meeting the edge 6 at the top end 10 of the pocket and continuing downward, stopping just short of the lower end of the pocket, in such a way as to define in the pocket, opposite the regions 8 of the troughs, a U path for the fluid between the inlet chamber and the outlet chamber (FIG. 2).

The bottom of each trough is interrupted, in each of the deeper regions 7, by an opening 11, and where the bottoms of one trough 2 are turned toward the bottoms of an adjacent trough 3, the bottoms are bonded fluidtightly together around the openings, by brazing.

The alignment of inlet/outlet chambers on the left-hand side of the figures forms a header box 16, and the alignment of inlet/outlet chambers on the right-hand side forms a header box 17 (FIG. 1). The header box 16 is subdivided by a transverse partition 18 into a connecting channel 12, extending from this partition to the end 4 of the stack, and a connecting channel 14 extending from the partition to the end 5. Similarly, a transverse partition 19, further from the end 4 than the partition 18, separates the header box 17 into a connecting channel 13 adjacent to the end 4 and a connecting channel 15 adjacent to the end 5. An end plate 20 is brazed to the bottom of the trough 3 situated at the end 4 of the stack, while an end box 21 (see also FIGS. 4 and 5) is brazed to the bottom of the trough 3 situated at the end 5 of the stack. In this way, the openings 11 of the troughs are closed off, which helps to define the connecting channels. The inlet/outlet chambers forming one connecting channel communicate with each other via the openings 11 in the troughs 2, 3.

A longitudinal nozzle 22, also known as a "pipette", extends the full length of the connecting channel 14. It is connected fluidtightly to the end box 21 and passes fluidtightly through the intermediate partition 18, in such a way as to allow communication between the connecting channel 12 (the upstream connecting channel) and that part of the coolant circuit which is situated upstream of the evaporator.

Also, the end box 21 comprises an opening 23 leading into the connecting channel 15, placing the latter in communication with the downstream part of the circuit.

The coolant enters the connecting channel 12 via the longitudinal nozzle 22 before passing into the connecting channel 13 by following the parallel U paths of a first group of pockets. It is then transferred to the connecting channel 14 via the U paths of a second group of pockets, and thence to the connecting channel 14 via the U paths of a third and final group of pockets. The fluid finally leaves the evaporator through the outlet opening 23. As it travels around the U paths, the fluid receives heat from an air stream passing horizontally through the evaporator from right to left as indicated by the arrow F1, via the gaps separating the opposing pockets of the regions 8 of the troughs.

Figure 3:
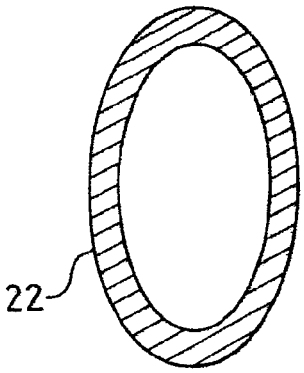
FIG. 3 is a view in transverse section through the longitudinal nozzle of the heat exchanger of FIGS. 1 and 2.

In accordance with the invention, the nozzle 22 has an oblong cross section, of oval form in the example (FIG. 3), the greatest dimension of which is parallel to the greatest dimension of the pockets. This means that the greatest dimension of the oval section is vertical when viewing FIG. 1.

Also, the nozzle 22 is offset from the center of the openings 11 of the troughs defining the header box 16. In the example shown, the nozzle is offset toward the exterior, in this case to the left, that is downstream in terms of the air stream F1. More particularly, the outline of each opening 11 is of an oval shape and is made up of two horizontal straight line segments 30 and two arcs of a circle 31 whose concavities are toward each other and which are joined to the segments 30 (FIG. 1). The nozzle 22 is in contact with one of the two arcs of a circle 31 (the one on the left) on the edge of the openings through which it passes, and is brazed to this edge all the way around the length of the leftmost arc of a circle 31. Consequently, the greatest dimension of the cross section of the nozzle 22 is perpendicular to the greatest dimension of the opening 11 (FIG. 1).

Figure 4:
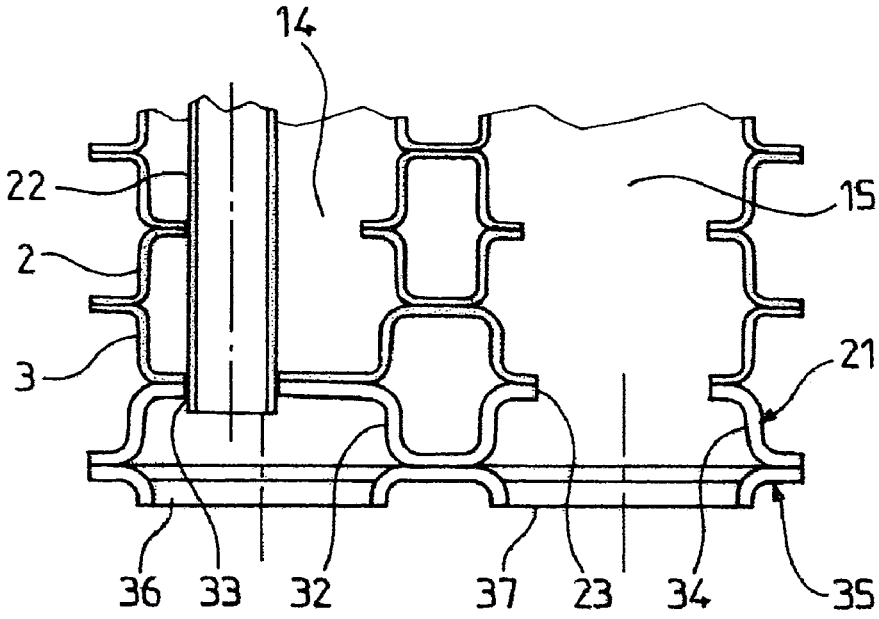
FIG. 4 is a detail on an enlarged scale from FIG. 2.
Figure 5:
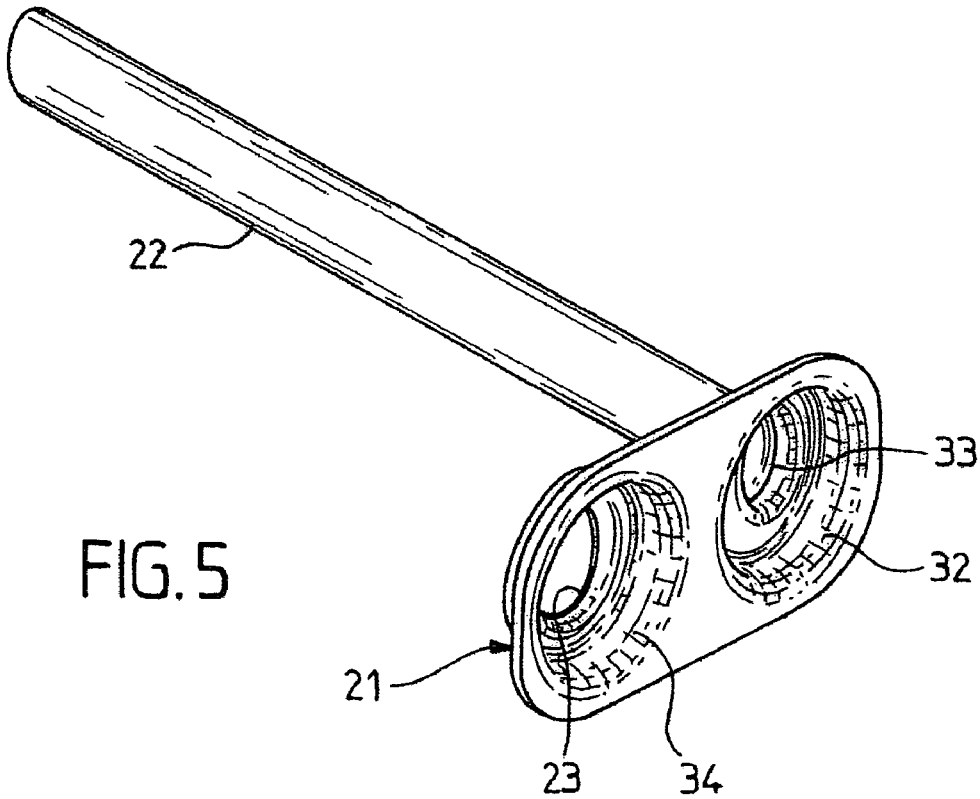
FIG. 5 is a perspective view showing a longitudinal nozzle/end box assembly suitable to form part of the heat exchanger of FIGS. 1 and 2.

As FIGS. 4 and 5 show, the longitudinal nozzle 22 is fixed to the end box 21 which is fitted to the end face 5 of the evaporator. This end box 21 has a first cavity 32 with an oval opening 33 through which the longitudinal nozzle 22 enters. The longitudinal nozzle 22 is crimped to the edges of this opening 33. The end box 21 also has a second cavity 34 in which the abovementioned opening 23 is formed and which connects with the downstream connecting channel 15. The end box 21 in this case has a two-trough shape similar to that of a plate 2.

This end box 21 accommodates a shaped plate 35 (FIGS. 2 and 4) that defines an entrance piece 36 communicating with the cavity 32 and therefore with the nozzle 22 and an exit piece 37 communicating with the second cavity 34, and therefore with the outlet opening 23. In this way an entrance piece and an exit piece are formed on the end of the evaporator, that is at the end of the stack of plates.

The longitudinal nozzle can be brazed to the edges of an opening 11 allowing communication between the upstream connecting channel 12 and an adjacent connecting channel 14 traversed by this longitudinal nozzle. This adjacent connecting channel 14 extends to the end face 5 of the heat exchanger.

In addition, the longitudinal nozzle 22 is brazed to the outer edge of the openings 11 that provide communication between each pocket and its neighbor.

In the embodiment illustrated, the longitudinal and lateral directions of the exchanger are essentially horizontal, while the header boxes 16 and 17 are situated at the top of the exchanger (FIG. 1).

It has been observed that due to the oblong shaping of the cross section of the longitudinal nozzle, the performance of the heat exchanger, in this case of the evaporator, is improved.

More specifically, it improves the passage of the fluid by limiting the internal head loss and enhancing its performance.

Due to its oblong shape, the longitudinal nozzle can be positioned so that it does not partly block the channels, and it is more suitable for the shape of the boxes.

The nozzle can thus be accommodated in plates of a relatively narrow width, typically less than 60 mm. This also improves the balance of the evaporator.

A significant improvement in the performance of the evaporator of the invention is observed.

The arrangement according to the invention also improves the uniformity of the exchange of heat through the volume of the evaporator, and consequently the uniformity of temperature distribution in the air stream coming out of the evaporator, with attenuation of the phenomena of hot and cold spots.

Moreover, the brazing of the longitudinal nozzle around a considerable length of the edges of the openings improves stiffness and reduces operational noise.

In the invention, the cross section of the nozzle may have an oblong shape that differs from an oval shape, for example an elliptical or rectangular or other shape.

The invention has a particular application to the construction of evaporators for vehicle air-conditioning devices.

The invention claimed is:

1. A heat exchanger for heat exchange between a first fluid and a second fluid, particularly an evaporator for an air-conditioning device for the passenger compartment of a motor vehicle, comprising a stack of pockets (1) mutually aligned in a longitudinal direction and having two header boxes (16, 17) that are mutually juxtaposed in a lateral direction and are each formed by the alignment, in the longitudinal direction, of inlet or outlet chambers belonging respectively to the different pockets, the header boxes as a whole being divided into at least three connecting channels, in which exchanger the first fluid is injected into an upstream connecting channel (12) by a longitudinal nozzle (22) passing through a heat exchanger end face (5) remote from the upstream connecting channel, and at least one other connecting channel (14) formed by other pockets, in which exchanger said longitudinal nozzle (22) has a cross section of oblong general shape, whose greatest dimension is parallel to the greatest dimension of the pockets (1).

2. The heat exchanger as claimed in claim 1, in which the cross section of the longitudinal nozzle (22) is of oval general shape.

3. The heat exchanger as claimed in claim 1, in which the longitudinal nozzle (22) is fixed to an end box (21) fitted to said end face (5).

4. The heat exchanger as claimed in claim 3, in which the end box (21) has a first cavity (32) with an opening (33) into which the longitudinal nozzle (22) passes and a second cavity (34) with an opening (23) leading into a downstream connecting channel (15) adjacent to said end (5) of the heat exchanger.

5. The heat exchanger as claimed in claim 4, in which the end box (21) accommodates a shaped plate (35) defining an entrance piece (36) communicating with the first cavity (32) and an exit piece (37) communicating with the second cavity (34).

6. The heat exchanger as claimed in claim 4, in which the longitudinal nozzle (22) is crimped to the edges of the opening (33) of the first cavity (32).

7. The heat exchanger as claimed in claim 1, in which the longitudinal nozzle (22) is brazed to the edges of an opening (11) allowing communication between the upstream connecting channel (12) and an adjacent connecting channel (14) through which the longitudinal nozzle (22) passes.

8. The heat exchanger as claimed in claim 7, in which said adjacent connecting channel (22) extends to the end face (5) of the heat exchanger.

9. The heat exchanger as claimed in claim 1, in which the longitudinal nozzle (22) is brazed to the outer edge of the openings (11) that allow communication between adjacent pockets (1).

10. The heat exchanger as claimed in claim 1, in which the longitudinal and lateral directions are essentially horizontal and the header boxes (16, 17) are located at the top of the exchanger.

* * * * *